US010946428B2

(12) United States Patent
Yoshii et al.

(10) Patent No.: US 10,946,428 B2
(45) Date of Patent: Mar. 16, 2021

(54) SPINNING APPARATUS AND SPINNING METHOD

(71) Applicant: TOPY KOGYO KABUSHIKI KAISHA, Tokyo (JP)

(72) Inventors: Kenji Yoshii, Toyohashi (JP); Hiroyasu Kato, Toyohashi (JP); Tatsuro Kakami, Toyohashi (JP); Keitaro Enami, Toyohashi (JP); Yuji Iwakura, Toyohashi (JP)

(73) Assignee: TOPY KOGYO KABUSHIKI KAISHA, Tokyo (JP)

( * ) Notice: Subject to any disclaimer, the term of this patent is extended or adjusted under 35 U.S.C. 154(b) by 233 days.

(21) Appl. No.: 16/070,174

(22) PCT Filed: Jan. 11, 2017

(86) PCT No.: PCT/JP2017/000563
§ 371 (c)(1),
(2) Date: Jul. 13, 2018

(87) PCT Pub. No.: WO2017/122656
PCT Pub. Date: Jul. 20, 2017

(65) Prior Publication Data

US 2019/0022728 A1 Jan. 24, 2019

(30) Foreign Application Priority Data

Jan. 14, 2016 (JP) ..... JP2016-004919

(51) Int. Cl.
*B21D 22/16* (2006.01)
*B21D 53/30* (2006.01)
*B21H 1/04* (2006.01)

(52) U.S. Cl.
CPC ..... *B21D 22/16* (2013.01); *B21D 53/30* (2013.01); *B21H 1/04* (2013.01)

(58) Field of Classification Search
CPC ..... B21D 22/16; B21D 53/30; B21D 53/264; B21D 22/14; B21D 22/18; B21H 1/04
See application file for complete search history.

(56) References Cited

U.S. PATENT DOCUMENTS 2,586,029 A * 2/1952 Greenshields ..... B21D 53/30 72/399
4,127,020 A 11/1978 Bosch
(Continued)

FOREIGN PATENT DOCUMENTS

DE 112011100571 T5 12/2012
JP S53-017563 A 2/1978
(Continued)

*Primary Examiner* — Debra M Sullivan
(74) *Attorney, Agent, or Firm* — Hunton Andrews Kurth LLP

(57) ABSTRACT

A spinning apparatus for decreasing by spinning a thickness of a portion of a tube material having a uniform thickness except at a first axial end portion is disclosed. The spinning apparatus includes a spindle-side chuck having a conical concavity and a mandrel. The mandrel has a mandrel-side chuck formed in a form of a conical convexity corresponding in configuration to the conical concavity of the spindle-side chuck and a cylindrical portion for supporting the tube material. The spinning apparatus further includes a spinning roll for decreasing the thickness of the tube material by pressing the spinning roll against the tube material when the tube material is supported by the cylindrical portion of the mandrel.

7 Claims, 13 Drawing Sheets

(56) References Cited

U.S. PATENT DOCUMENTS

| | | | | |
|---|---|---|---|---|
| 5,740,609 | A | 4/1998 | Jurus | |
| 6,436,209 | B1 | 8/2002 | Wozniak et al. | |
| 2008/0314113 | A1* | 12/2008 | Minoguchi ..... | F15B 15/1438<br>72/370.06 |
| 2012/0304723 | A1 | 12/2012 | Abe et al. | |

FOREIGN PATENT DOCUMENTS

| | | | |
|---|---|---|---|
| JP | S5317563 | A | 2/1978 |
| JP | S60-121024 | A | 6/1985 |
| JP | S60121024 | A | 6/1985 |
| JP | S62-220231 | A | 9/1987 |
| JP | S62220231 | A | 9/1987 |
| JP | 2011-036912 | A | 2/2011 |
| JP | 2014-176859 | A | 9/2014 |
| JP | 2014176859 | A | 9/2014 |
| JP | 2015-039712 | A | 3/2015 |

* cited by examiner

SPINNING APPARATUS AND SPINNING METHOD

CROSS REFERENCE TO RELATED APPLICATIONS

This application is a National Phase filing under 35 U.S.C. § 371 of PCT/JP2017/000563 filed on Jan. 11, 2017, and this application claims priority to Application No. 2016-004919 filed in Japan on Jan. 14, 2016 under 35 U.S.C. § 119; the entire contents of all are hereby incorporated by reference.

The present invention relates to a spinning apparatus and a spinning method conducted using the apparatus.

BACKGROUND

Patent Document 1 discloses the following technique:

As illustrated in FIG. 14, one axial end portion of a cylindrical workpiece 2 is clamped by a clamp chuck 3 so that a workpiece 2 is set to a die 1 having a first inclined portion 1*a*, an intermediate forming portion 1*c* and a second inclined portion 1*b*. Another axial end portion of the cylindrical workpiece 2 is a free end portion which is not clamped.

Then, by using a roll (spinning roll) R, a workpiece portion 2*a* corresponding to the first inclined portion 1*a* is firstly formed.

Then, by using the roll R, a workpiece portion 2*b* corresponding to the second inclined portion 1*b* and a workpiece portion 2*c* corresponding to the intermediate forming portion 1*c* are formed.

Lastly, by using the roll R, the workpiece portion 2*a* corresponding to the first inclined portion 1*a* is ironed so that the workpiece portion 2*a* is lengthened in an axial direction of the workpiece.

However, there are the following problems with the technique disclosed in Patent Document 1:

(i) After the one axial end portion of the cylindrical workpiece 2 has been clamped and the workpiece portions 2*a*, 2*b*, 2*c* corresponding to the first inclined portion 1*a*, the second inclined portion 1*b*, the intermediate forming portion 1*c*, respectively, have been formed, the workpiece portion 2*a* corresponding to the first inclined portion 1*a* is ironed to be decreased in thickness. Therefore, the number of processes are large and a forming time is long.

(ii) Since the die 1 includes the first inclined portion 1*a*, the second inclined portion 1*b* and the intermediate forming portion 1*c*, it is difficult to commonly use the die 1 as a die for forming various wheel rims.

RELATED ART DOCUMENT

Patent Document 1: JP2011-36912

SUMMARY OF THE INVENTION

Object of the Invention

An object of the invention is to provide a spinning apparatus and a spinning method which are achieve at least one of shortening a forming time and using a common die as a die for forming various wheel rims.

Means for Solving the Problems

The present invention capable of achieving the above object is as follows:

(1) A spinning apparatus for decreasing by spinning a thickness of at least a portion of a tube material having a uniform thickness except at a first axial end portion thereof comprising:

a spindle-side chuck having a conical concavity;

a mandrel including (i) a mandrel-side chuck formed in a form of a conical convexity corresponding in configuration to the conical concavity of the spindle-side chuck and (ii) a cylindrical portion for supporting the tube material; and a spinning roll for decreasing the thickness of the tube material by pressing the spinning roll against the tube material when the tube material is supported by the cylindrical portion of the mandrel.

(2) In the spinning apparatus according to item (1) above, the first axial end portion of the tube material is squeezed between the conical concavity of the spindle-side chuck and the mandrel-side chuck of the mandrel so that the tube material is clamped.

(3) In the spinning apparatus according to item (1) or (2) above, a diameter of an axially outermost end of the mandrel-side chuck of the mandrel is smaller than an inner diameter of an axially outermost end of at least the second axial end portion of the tube material.

A diameter of the cylindrical portion of the mandrel is larger than an inner diameter of at least an axially outermost end of the first axial end portion of the tube material.

(4) A spinning method of decreasing by spinning a thickness of at least a portion of a tube material having a uniform thickness except at a first axial end portion thereof comprises:

clamping the tube material at the first axial end portion of the tube material between a conical concavity of the spindle-side chuck and a mandrel-side chuck of a mandrel, the mandrel-side chuck formed in a form of a conical convexity, then decreasing by spinning a thickness of the tube material by pressing a spinning roll against the tube material supported by a cylindrical portion of the mandrel.

(5) In the spinning method according to item (4) above, the first axial end portion of the tube material is formed to a conical configuration and is squeezed between the conical concavity of the spindle-side chuck and the mandrel-side chuck of the mandrel so that the tube material is clamped to a spinning apparatus at the first axial end portion of the tube material.

(6) In the spinning method according to item (4) or (5), the cylindrical portion of the mandrel having a diameter equal to or larger than an inner diameter of the tube material is forcibly inserted into the tube material so that the diameter of the tube material is enlarged and the first axial end portion of the tube material is formed to a conical configuration.

(7) A method of manufacturing a vehicle wheel rim from a tube material having a uniform thickness is conducted by using a spinning apparatus which includes (a) a spindle-side chuck having a conical concavity, (b) a mandrel including (i) a mandrel-side chuck formed in a form of a conical convexity corresponding in configuration to the conical concavity of the spindle-side chuck and (ii) a cylindrical portion for supporting a tube material and (c) a spinning roll for decreasing a thickness of the tube material by pressing the spinning roll against the tube material when the tube material is supported by the cylindrical portion of the mandrel.

The method comprises:

clamping the tube material at a first axial end portion of the tube material between the conical concavity of the spindle-side chuck and the mandrel-side chuck of the mandrel, the mandrel-side chuck formed in a form of a conical convexity;

decreasing by spinning a thickness of the tube material by pressing the spinning roll against the tube material supported by the cylindrical portion of the mandrel to form a formed tube having a non-uniform thickness; and flaring axially opposite ends of the formed tube to conical configurations.

Technical Advantages of the Invention

According to the spinning apparatus described in item (1) above or the spinning method described in item (4) above, by clamping the tube material at the first axial end portion of the tube material between the conical concavity of the spindle-side chuck and the mandrel-side chuck and then pressing the spinning roll against the tube material when the tube material is supported by the cylindrical portion of the mandrel, the thickness of the tube material can be decreased. Therefore, a clamping structure is simpler and fewer forming processes are used as compared with conventional spinning, so that a forming time can be shortened.

Further, since the thickness of the tube material is decreased by pressing the spinning roll against the tube material when the tube material is supported by the cylindrical portion of the mandrel, the tube material after the thickness thereof has been decreased has a simpler configuration than a tube material after the thickness thereof has been decreased by using a conventional die. Therefore, it is relatively easy to use the mandrel die as a common die for forming various wheel rims.

According to the spinning apparatus described in item (2) above, since the first axial end portion of the tube material is squeezed between the conical concavity of the spindle-side chuck and the mandrel-side chuck of the mandrel so that the tube material is clamped, the tube material can be securely clamped at the first axial end portion of the tube material.

According to the spinning apparatus described in item (3) above, since the diameter of the axially outermost end of the mandrel-side chuck of the mandrel is smaller than the inner diameter of the axially outermost end of the second axial end portion of the tube material, the mandrel can be securely inserted into the tube material.

Further, since the diameter of the cylindrical portion of the mandrel is larger than the inner diameter of at least an axially outermost end of the first axial end portion of the tube material, the tube material can be stably supported by the cylindrical portion of the mandrel.

According to the spinning method described in item (5) above, since the first axial end portion of the tube material is formed to a conical configuration by being squeezed between the conical concavity of the spindle-side chuck and the mandrel-side chuck of the mandrel so that the tube material is clamped to the spinning apparatus at the first axial end portion of the tube material, the tube material can be securely clamped by fewer process steps.

According to the spinning method described in item (6) above, since the cylindrical portion of the mandrel having a diameter equal to or larger than an inner diameter of the tube material is forcibly inserted into the tube material so that the diameter of the tube material is enlarged and the first axial end portion of the tube material is formed to a conical configuration, a true roundness of the tube material and a dimension accuracy of the inner diameter of the tube material are improved, whereby the thickness reduction can be stably performed.

According to the method of manufacturing a vehicle wheel rim described in item (7) above, the method is conducted by using the spinning apparatus which includes (a) the spindle-side chuck having the conical concavity, (b) the mandrel including (i) the mandrel-side chuck formed with a conical convexity corresponding in configuration to the conical concavity of the spindle-side chuck and (ii) the cylindrical portion for supporting a tube material and (c) a spinning roll for decreasing a thickness of the tube material by pressing the spinning roll against the tube material when the tube material is supported by the cylindrical portion of the mandrel. The method comprises: clamping the tube material at the first axial end portion of the tube material between the conical concavity of the spindle-side chuck and the mandrel-side chuck formed with a conical convexity of the mandrel; decreasing by spinning the thickness of the tube material by pressing the spinning roll against the tube material supported by the cylindrical portion of the mandrel to form a formed tube having a non-uniform thickness; and flaring axially opposite ends of the formed tube to conical configurations.

Therefore, the vehicle wheel rim can be efficiently manufactured by simple processes.

DETAILED DESCRIPTION

An apparatus and a method of spinning according to an embodiment of the present invention will be explained with reference to the drawings.

Figure 11:
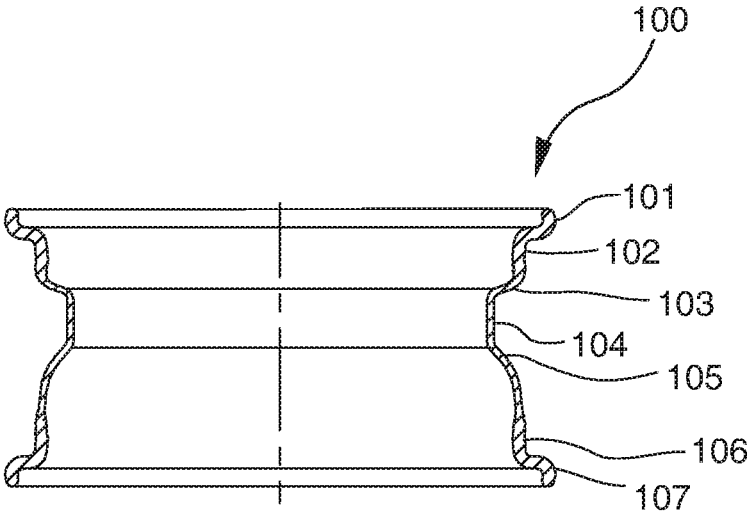
FIG. 11 is a cross-sectional view of the vehicle wheel rim after roll-forming according to a first embodiment of the present invention.

A spinning apparatus 20 and a spinning method according to the present invention is used for manufacturing a vehicle wheel rim 100 as shown in FIG. 11. The rim 100 is, for example, a rim for use in a car, a truck, a bus or an industrial vehicle.

The rim 100 includes a flange 101, a bead seat 102, a side wall 103, a drop 104, a side wall 105, a bead seat 106 and a flange 107, disposed in that order from a first axial end to the other axial end of the rim. The flanges 101, 107 are larger in diameter than the bead seats 102, 106. The drop 104 is smaller in diameter than the bead seats 102, 106. A wheel disk (not shown) is fit into the rim 100 and then welded to the rim, whereby a vehicle wheel of a weld type is manufactured. The rim 100 may be a wheel rim, where one of the flanges 101,107 of the rim is removed and the removed rim flange portion is replaced by a rim flange portion which is formed integral with the wheel disk (not shown).

As illustrated in FIGS. 2-6, a thickness of a tube material 10 having a uniform thickness is decreased by the spinning apparatus 20. The tube material 10 is made from metal, and the metal is, for example, steel. Alternatively, the tube material 10 may be made from non-ferrous metal (including aluminum, magnesium, titanium and alloys thereof).

As illustrated in FIGS. 2-6, a thickness of at least a portion of the tube material 10 having a uniform thickness except a first axial end portion 11 thereof is decreased by the spinning apparatus 20. The tube material 10 having a uniform thickness is formed to a formed tube 15 (shown in FIG. 6), an outer surface of which including convex and concave portions formed by spinning using the spinning apparatus 20. The spinning apparatus 20 includes a spindle-side chuck 30, a mandrel 40 and a spinning roll 50. An axis P of the mandrel 40 coincides with an axis P of the spindle-side chuck 30. A plurality of spinning rolls 50 may be arranged in a circumferential direction of the mandrel 40.

Figure 2:
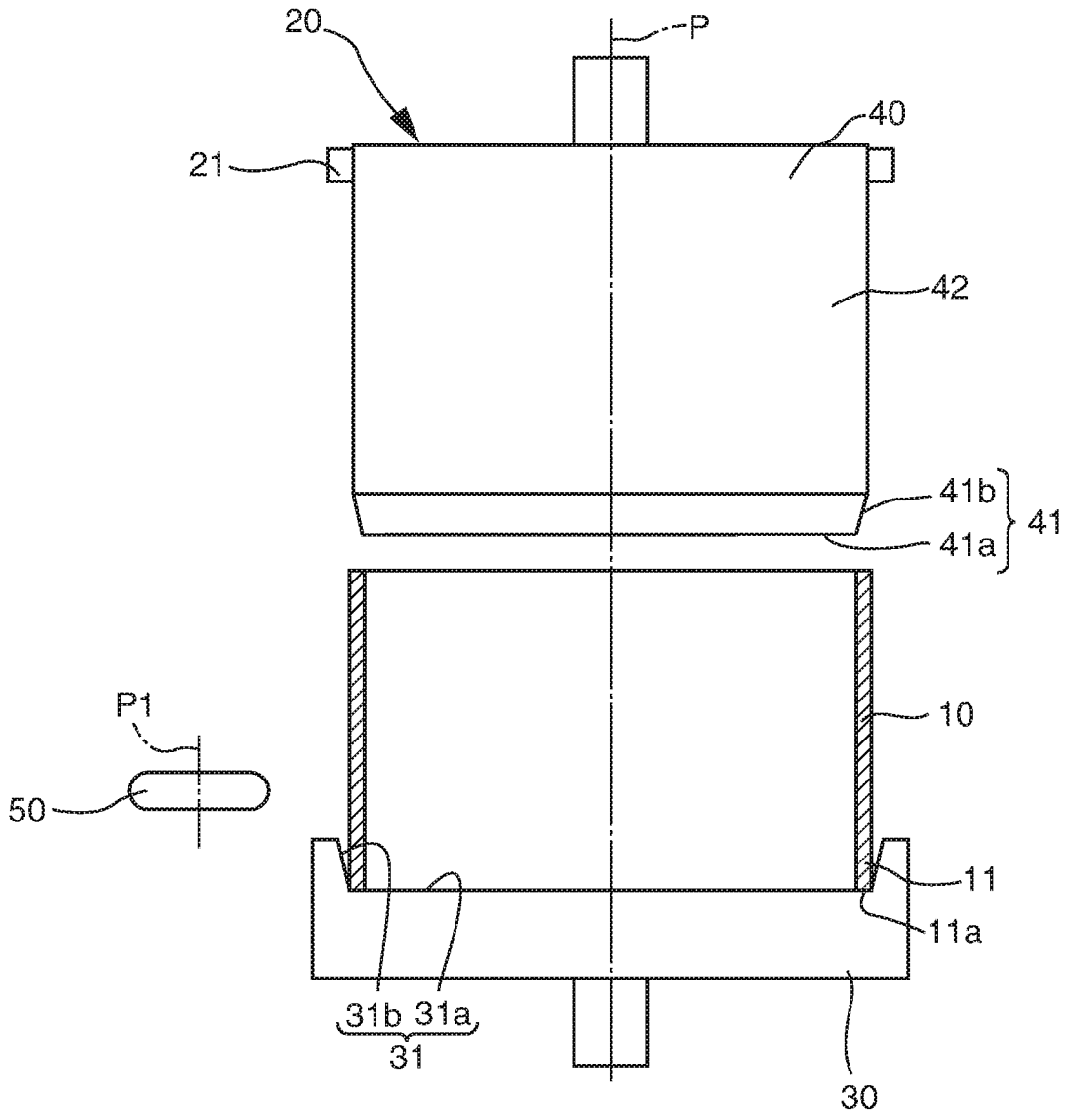
FIG. 2 is a cross-sectional view of a spinning apparatus according to a first embodiment of the present invention, in a state before the tube material is clamped at a first axial end portion thereof by a conical concavity of a spindle-side chuck and a mandrel-side chuck formed with a conical convexity.

The spindle-side chuck 30 has a conical concavity 31. As illustrated in FIG. 2, the conical concavity 31 of the spindle-side chuck 30 is formed to be concave in an axial direction of the tube material 10, so that the first axial end portion 11 of the tube material 10 can be inserted into the conical concavity 31. An axis P of the tube material 10 coincides with the axis P (of the conical concavity 31) of the spindle-side chuck 30. An inner diameter of the conical concavity 31 gradually increases in a direction approaching the mandrel 40.

The conical concavity 31 includes a bottom surface 31*a* and an inwardly facing side surface 31*b*. An axially outermost end 11*a* of the first axial end portion 11 of the tube material 10 is contacted to the bottom surface 31*a*, so that a position of the tube material 10 relative to the spinning apparatus in the axial direction of the tube material 10 is determined.

A diameter of the bottom surface 31*a* of the conical concavity 31 may be larger than an outer diameter of the tube material 10 or may be smaller than the outer diameter of the tube material 10. It is preferable that the diameter of the bottom surface 31*a* of the conical concavity 31 coincides or substantially coincides with the outer diameter of the tube material 10 in order that the tube material 10 can be stably set on the spindle-side chuck 30. If the diameter of the bottom surface 31*a* is larger than the outer diameter of the tube material 10, the axis P of the tube material 10 is likely to be offset from the axis P of the conical concavity 31 when setting the tube material 10 on the spindle-side chuck. If the diameter of the bottom surface 31*a* is smaller than the outer diameter of the tube material 10, an axial position of the tube material 10 relative to the spindle-side chuck 30 is likely offset from a correct position when setting the tube material 10 on the spindle-side chuck 30.

Figure 9:
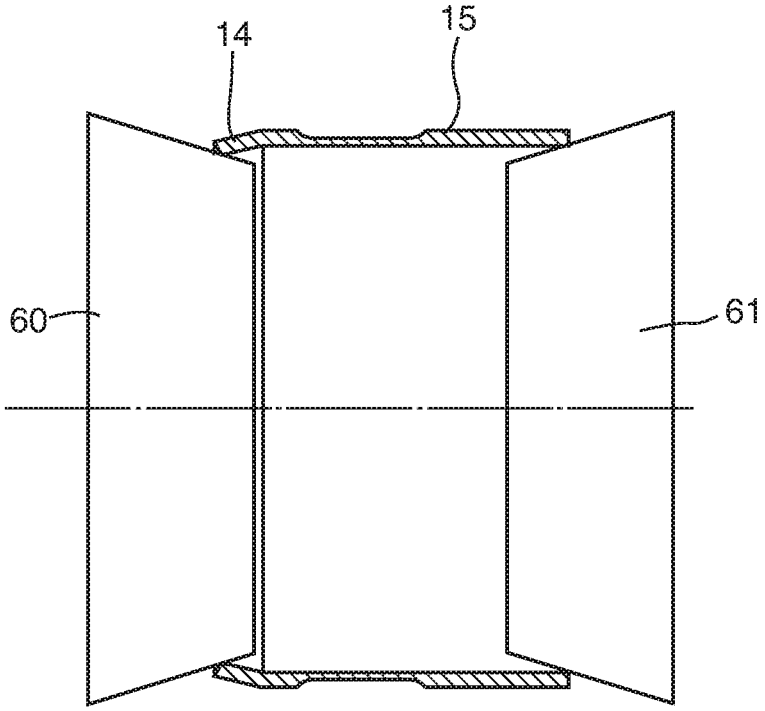
FIG. 9 is a process diagram illustrating a step for flaring the formed tube which has been decreased in thickness by a spinning method according to a first embodiment of the present invention, where (a) illustrates a state of the formed tube before flaring, and (b) illustrates a state of the formed tube after flaring.
Figure 9:
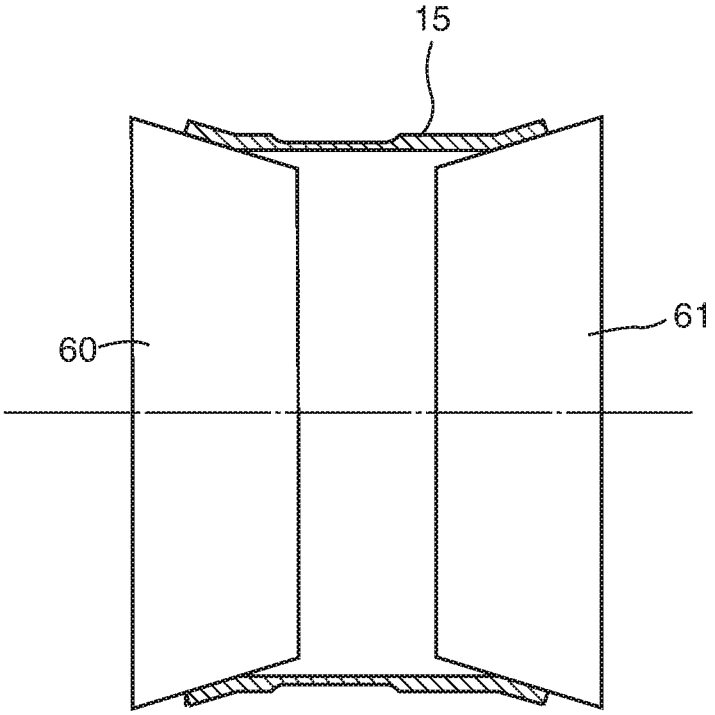
Figure 10A:
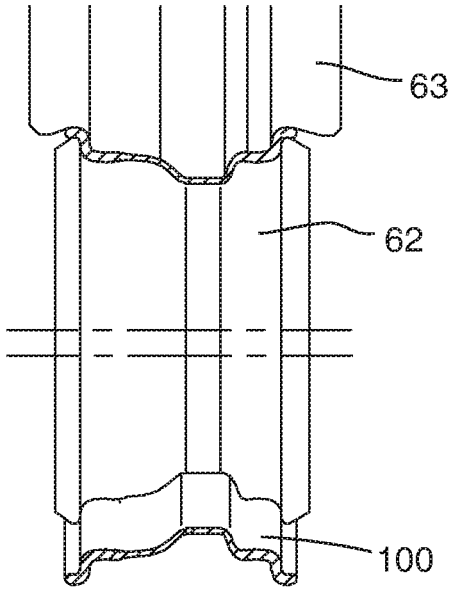
FIG. 10 is a process diagram illustrating a roll-forming step which is conducted after flaring step according to a first embodiment of the present invention, where (a) is a side view of an upper roll and a lower roll between which the wall of the formed tube is disposed and roll-formed to a vehicle wheel rim configuration, where the formed tube is shown in cross section, and (b) is a front view of the upper roll and the lower roll between which the wall of the formed tube is disposed and is roll-formed to the vehicle wheel rim configuration.
Figure 10B:
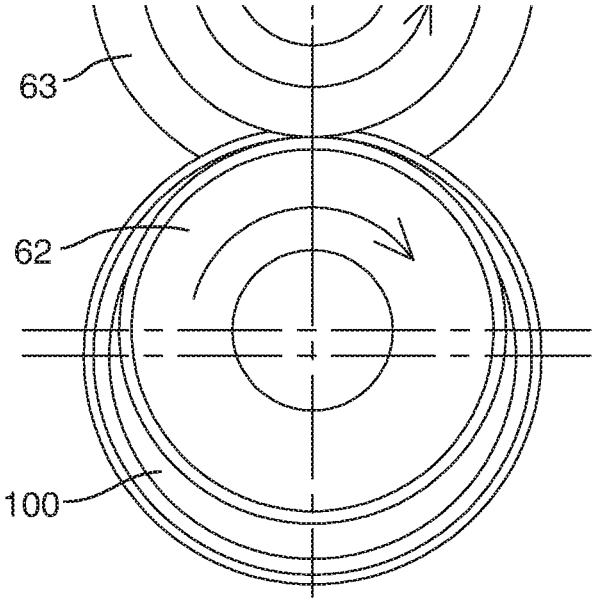

The inwardly facing side surface 31*b* is continuous over an entire circumference thereof. However, the inwardly facing side surface 31*b* may have a recess receding radially outwardly, partially in a circumference thereof. An inclination angle of the inwardly facing side surface 31*b* relative to the axis P of the spindle-side chuck is constant over the entire circumference thereof. However, the inclination angle of the inwardly facing side surface 31*b* relative to the axis P may be varied in an axial direction of the inwardly facing side surface. The inclination angle of the inwardly facing side surface 31*b* relative to the axis P is determined to be an angle where the tube material 10 can be clamped between the spindle-side chuck 30 and the mandrel 40 and where the formed tube 15 can be easily removed from the conical concavity 31 of the spindle-side chuck 30. As illustrated in FIGS. 9 and 10, the inclination angle of the inwardly facing side surface 31*b* relative to the axis P is within a range that does not cause any problem when the formed tube 15 is flared and roll-formed.

As illustrated in FIG. 2, the mandrel 40 includes (i) a mandrel-side chuck 41 formed with a conical convexity corresponding in configuration to the conical concavity 31 of the spindle-side chuck 30 and (ii) a cylindrical portion 42 for supporting the tube material 10.

The mandrel-side chuck 41 is provided at an axial end portion of the mandrel 40. The mandrel-side chuck 41 is provided so as to protrude from the cylindrical portion 42 in a direction approaching the spindle-side chuck 30 in an axial direction of the mandrel 40. The axis P (of the mandrel-side chuck 41 and the cylindrical portion 42) of the mandrel 40 coincides with the axis P of the tube material 10. It is preferable that the axis of the spindle-side chuck 30 and the axis of the mandrel 40 are directed in a vertical direction. In the case where the axis of the spindle-side chuck 30 and the axis of the mandrel 40 are directed in a vertical direction, alignment between the tube material 10 and the spindle-side chuck 30 is relatively easy.

The mandrel-side chuck 41 can be inserted into the conical concavity 31. A diameter of the mandrel-side chuck 41 gradually decreases toward the spindle-side chuck 30.

The mandrel-side chuck 41 includes an end surface 41*a* and an outwardly facing side surface 41*b*. A size and a configuration of the end surface 41*a* of the mandrel-side chuck 41 are selected such that the end surface 41*a* does not contact the bottom surface 31*a* of the conical concavity 31 when forming the tube material 10 to the formed tube. The outwardly facing side surface 41*b* of the mandrel-side chuck 41 is continuous over the entire circumference thereof. An inclination angle of the outwardly facing side surface 41*b* relative to the axis P of the mandrel-side chuck is constant over the entire circumference thereof. The inclination angle of the outwardly facing side surface 41*b* relative to the axis P of the mandrel-side chuck is substantially equal to the inclination angle of the inwardly facing side surface 31*b* of the conical concavity 31 relative to the axis P of the mandrel-side chuck. However, the inclination angle of the outwardly facing side surface 41*b* relative to the axis P may be different from the inclination angle of the inwardly facing side surface 31*b* of the conical concavity 31 relative to the axis P at (i) a boundary between the mandrel-side chuck 41 and the cylindrical portion 42, (ii) a boundary between the outwardly facing side surface 41*b* and the end surface 41*a* or (iii) another portion of the mandrel.

Figure 12:
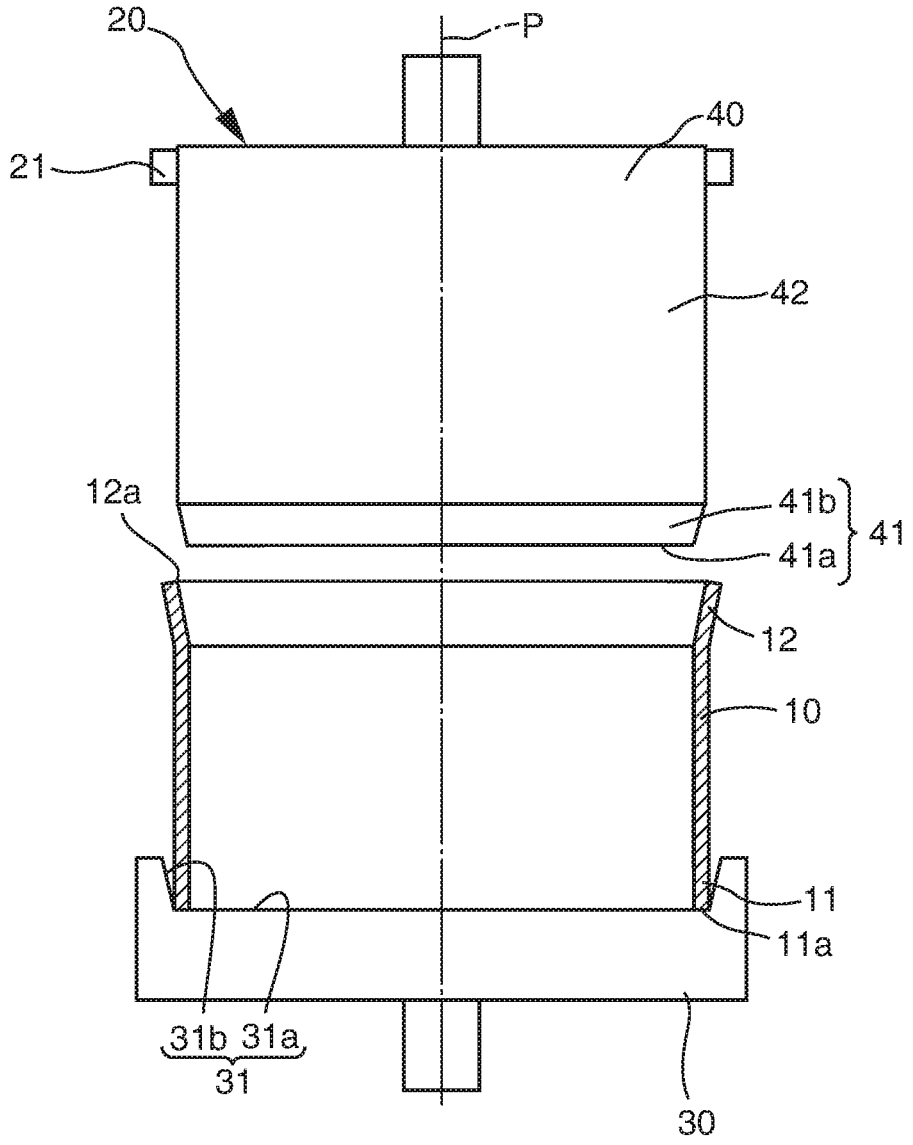
FIG. 12 is a cross-sectional view of the spinning apparatus according to a second embodiment of the present invention, in a case where a first axial end portion of a tube material has been enlarged beforehand in diameter to a conical configuration at another step different from the above spinning step, in a state before the tube material at the first axial end portion thereof is clamped by the conical concavity of the spindle-side chuck and the mandrel-side chuck formed with a conical convexity.

A diameter of an axially outermost end of the mandrel-side chuck 41 is smaller than the inner diameter of the tube material 10. Therefore, the mandrel 40 can be easily inserted into the tube material 10. However, as illustrated in FIG. 12, in a case where the diameter of the axially outermost end of the mandrel-side chuck 41 is smaller than an inner diameter of an axially outermost end 12*a* of an opposite axial end portion 12 (i.e., the end portion on the side where the mandrel-side chuck 41 is inserted) of the tube material 10, the diameter at the axially outermost end of the mandrel-side chuck 41 may be larger than the inner diameter of the tube material 10 except at a location of the opposite axial end portion 12 of the tube material.

Figure 13:
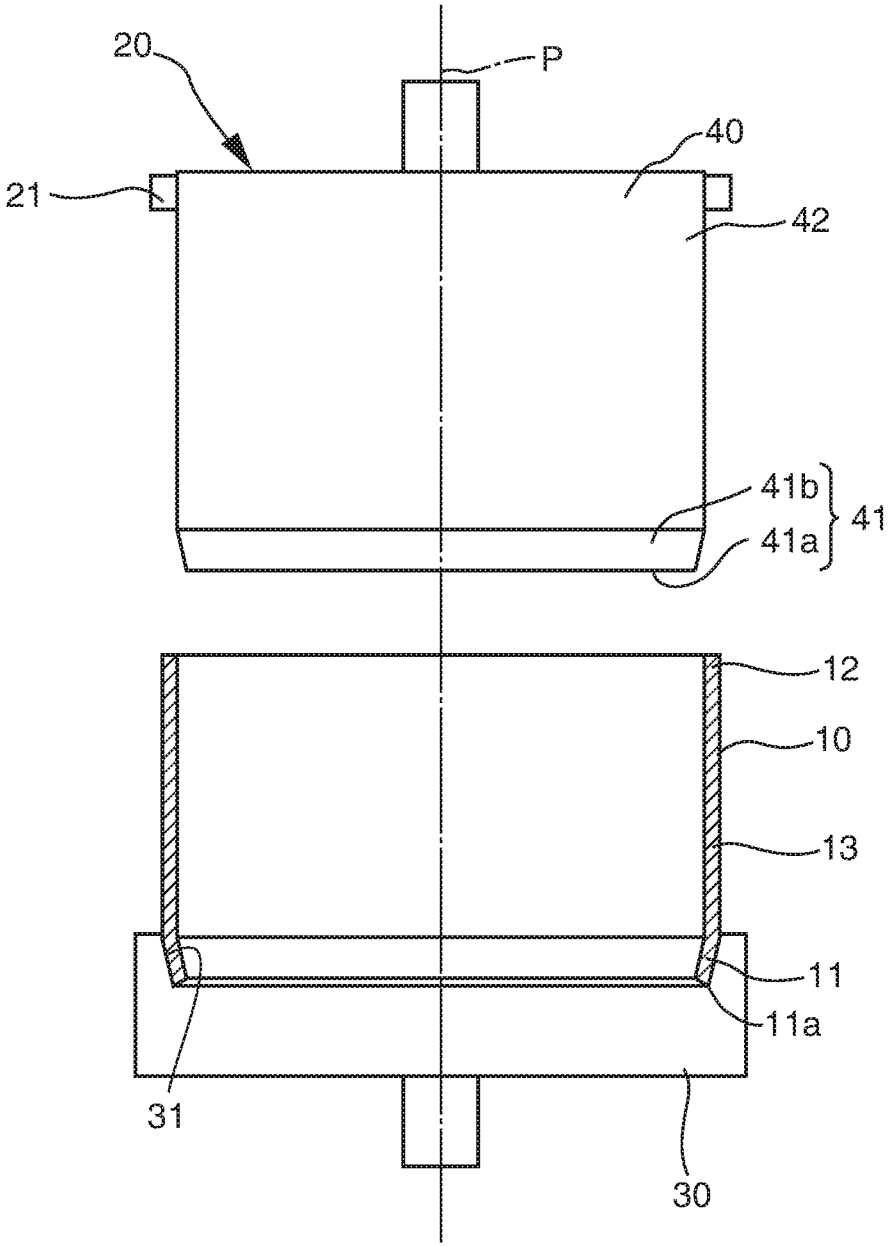
FIG. 13 is a cross-sectional view of the spinning apparatus according to a third embodiment of the present invention, in a case where a first axial end portion of a tube material has been reduced beforehand in diameter to a conical configuration at another step different from the above spinning step, in a state before the tube material at the first axial end portion thereof is clamped by the conical concavity of the spindle-side chuck and the mandrel-side chuck formed with a conical convexity.
Figure 14A:
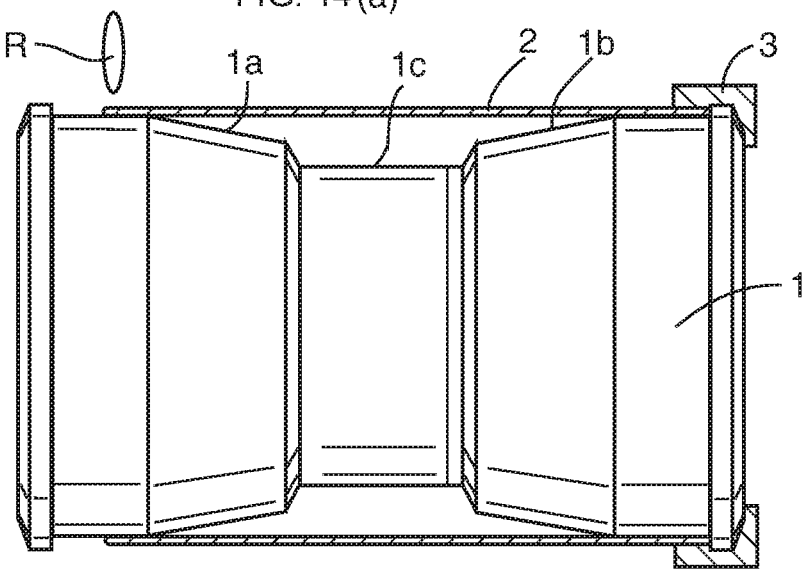
PRIOR ART FIG. 14(a)
FIG. 14 is a process diagram illustrating a spinning step of a conventional spinning method, where (a) illustrates a state of a cylindrical workpiece before spinning, and (b) illustrates a state of the cylindrical workpiece after spinning.
Figure 14B:
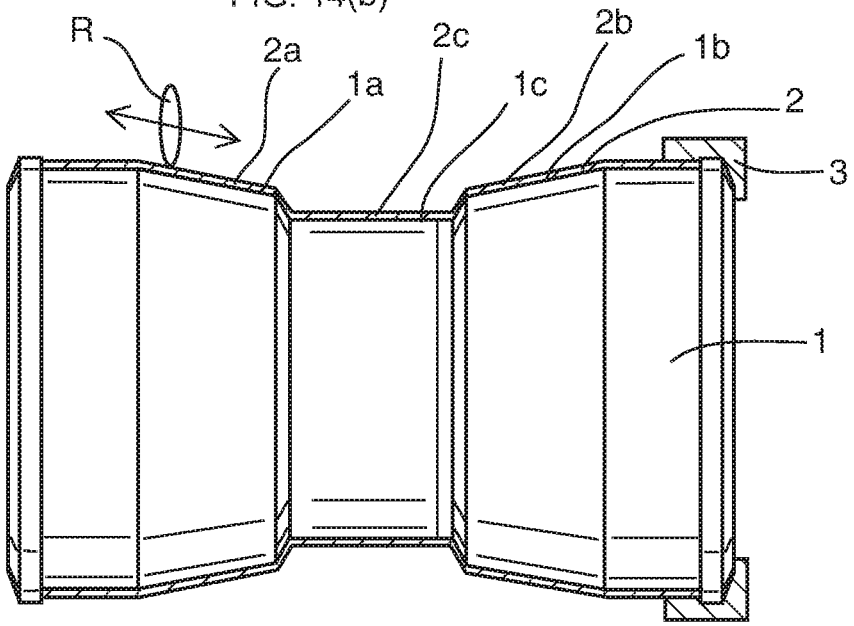

A diameter of a cylindrical portion 42 of the mandrel-side chuck 41 is larger than the inner diameter of the tube material 10 except at a location of the opposite axial end portion 12 of the tube material. Therefore, when the mandrel 40 is inserted into the tube material 10, the tube material 10 is enlarged in diameter by the mandrel 40. However, as illustrated in FIG. 13, in a case where the first axial end portion 11 (i.e., the end portion on the side inserted into the conical concavity 31) of the tube material 10 is reduced in diameter in a direction approaching the axially outermost end of the first axial end portion 11 so as to form a conical configuration, the diameter of the cylindrical portion 42 of the mandrel-side chuck 41 may be equal to or slightly smaller than the inner diameter of the tube material 10 except at a location of the first axial end portion 11 of the tube material.

A diameter of the cylindrical portion 42 of the mandrel 40 is constant over the entirety of the cylindrical portion 42 in an axial direction of the cylindrical portion. However, (i) the diameter of the cylindrical portion 42 of the mandrel may be slightly smaller than a diameter of the mandrel at the boundary between the mandrel-side chuck 41 and the cylindrical portion 42, (ii) the diameter of the cylindrical portion of the mandrel may be slightly and gradually enlarged in a direction away from the mandrel-side chuck 41 or (iii) some convex-concave portions may be formed at the cylindrical portion 42. The diameter of the cylindrical portion 42 of the mandrel is equal to or substantially equal to the diameter of the cylindrical portion 42 of the mandrel-side chuck 41, so that the tube material 10 can be securely supported by the cylindrical portion. The diameter of the cylindrical portion 42 of the mandrel is larger than an inner diameter at the axially outermost end 11*a* of the first axial end portion 11 of the tube material 10.

Figure 3:
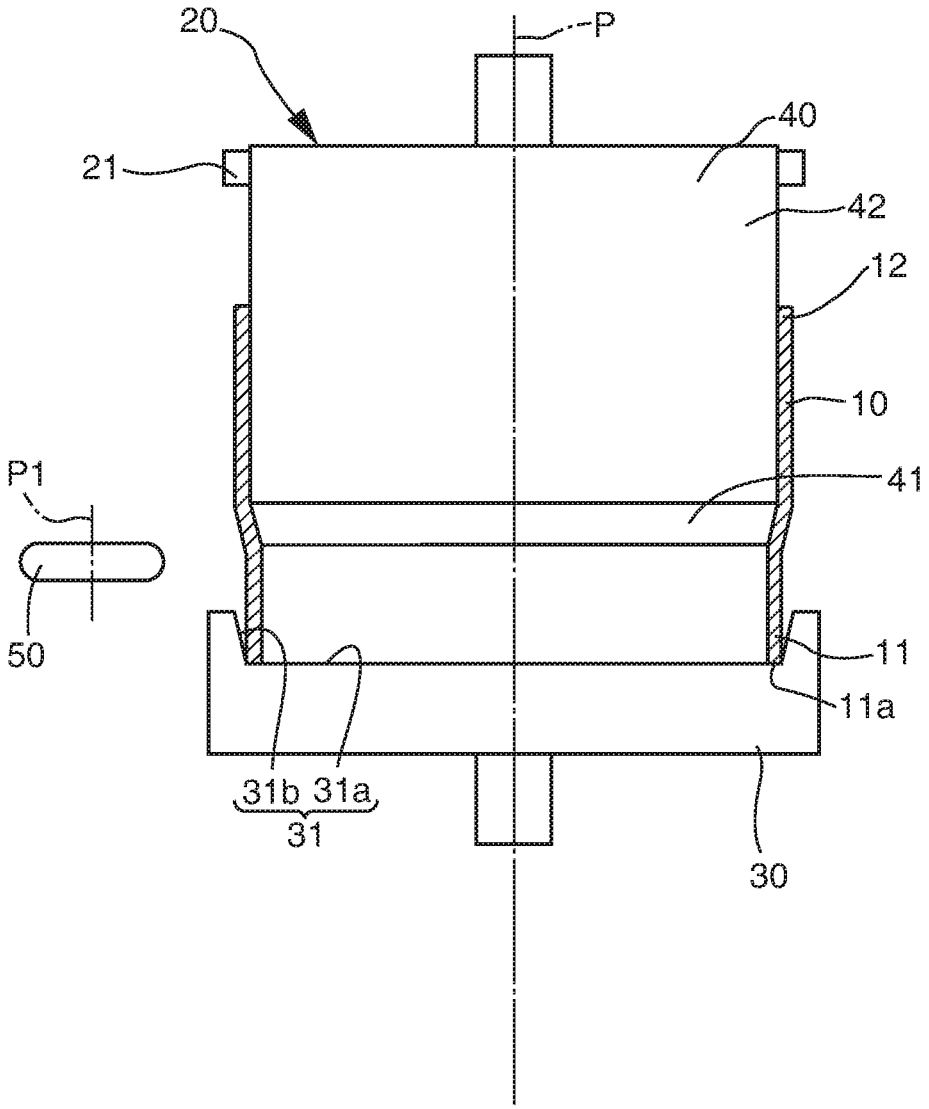
FIG. 3 is a cross-sectional view of the spinning apparatus according to a first embodiment of the present invention, in a state where the mandrel is being inserted into the tube material and the tube material is being enlarged by the mandrel-side chuck formed with a conical convexity.

As illustrated in FIG. 3, after the tube material 10 has been inserted into the conical concavity 31 of the spindle-side chuck 30, the mandrel-side chuck 41 of the mandrel 40 is inserted into the tube material 10 from the side of the opposite axial end portion 12 of the tube material 10 so that the tube material is enlarged in diameter. The portion of the tube material 10 which is being enlarged in diameter by the mandrel-side chuck 41 is deformed to a conical configuration.

Figure 4:
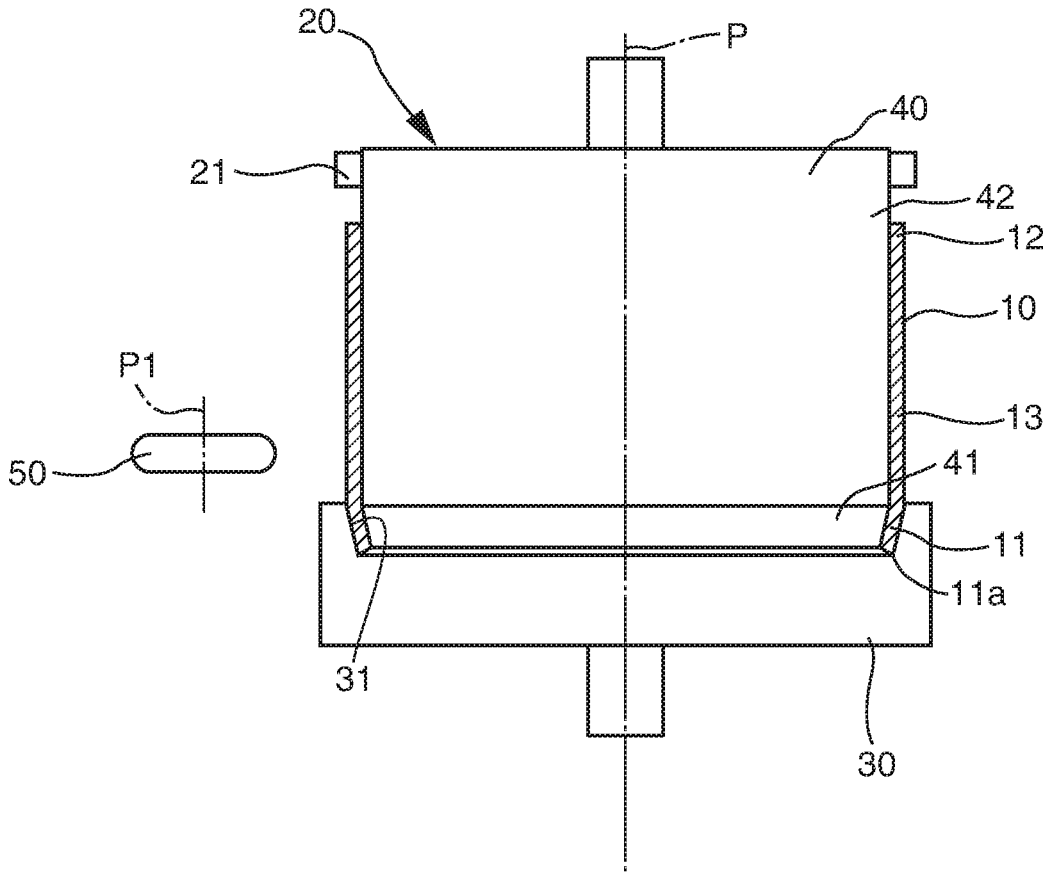
FIG. 4 is a cross-sectional view of the spinning apparatus according to a first embodiment of the present invention, in a state where the first axial end portion of the tube material has been clamped by the conical concavity of the spindle-side chuck and the mandrel-side chuck of a mandrel.

As illustrated in FIG. 4, the mandrel-side chuck 41 of the mandrel 40 is further inserted into the tube material 10, whereby the first axial end portion 11 of the tube material 10 is deformed to a conical configuration and is squeezed between the inwardly facing side surface of the conical concavity 31 of the spindle-side chuck 30 and the outwardly facing side surface of the mandrel-side chuck 41 of the mandrel 40. As a result, the tube material 10 is clamped to the spinning apparatus 20.

The spindle-side chuck 30 and the mandrel 40 are rotated about the axis P of the tube material 10. In a state where the tube material 10 is clamped to the spinning apparatus 20, the spindle-side chuck 30, the mandrel 40 and the tube material 10 have the common axis. The spinning roll 50 is movable in the axial direction and in a radial direction of the tube material 10.

Figure 5:
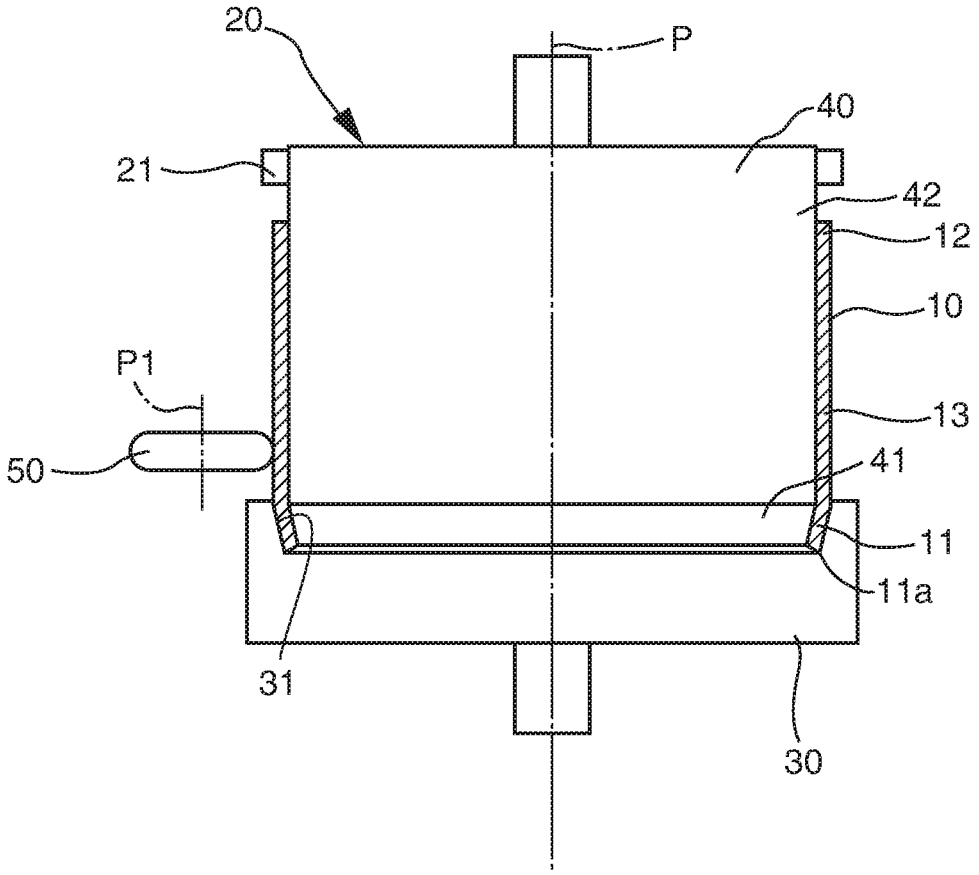
FIG. 5 is a cross-sectional view of the spinning apparatus according to a first embodiment of the present invention, in a state before decreasing a thickness of the tube material.

As illustrated in FIG. 5, the spinning roll 50 is rotatable about an axis P1 of the spinning roll 50. The spinning roll 50 is pressed against the tube material 10 supported by the cylindrical portion 42 of the mandrel 40. The thickness of the tube material 10 is decreased by the spinning roll 50.

Next, the spinning method according to the embodiment of the present invention will be explained.

The spinning method according to the embodiment of the present invention is a method of decreasing by spinning, a thickness of at least a portion of the tube material 10 having a uniform thickness except the first axial end portion 11 thereof.

Figure 6:
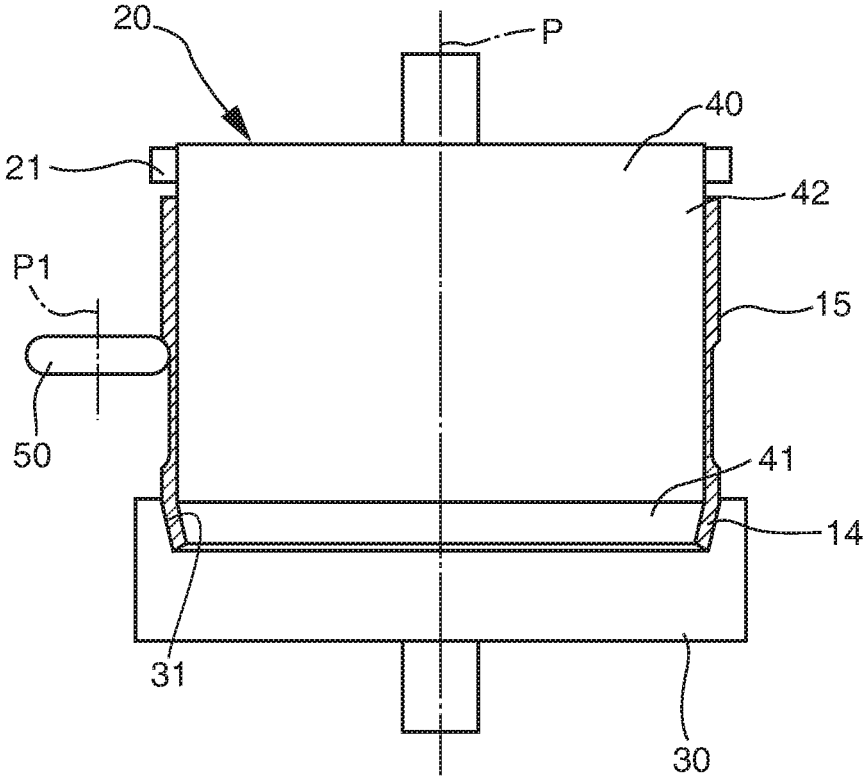
FIG. 6 is a cross-sectional view of the spinning apparatus according to a first embodiment of the present invention, in a state where the thickness of the tube material is being decreased.

The spinning method according to the embodiment of the present invention includes the following steps:

(A) as illustrated in FIGS. 2-4, clamping the tube material 10 at the first axial end portion 11 of the tube material between the inwardly facing side surface of the conical concavity 31 of the spindle-side chuck 30 and the outwardly facing side surface of the mandrel-side chuck 41 formed with a conical convexity; and (B) then, as illustrated in FIGS. 5 and 6, decreasing by spinning a thickness of the tube material 10 by pressing the spinning roll 50 against the tube material 10 which is supported by the cylindrical portion 42 of the mandrel 10.

Figures 1A, 1B, 1C, 1D, 1E, 1F:
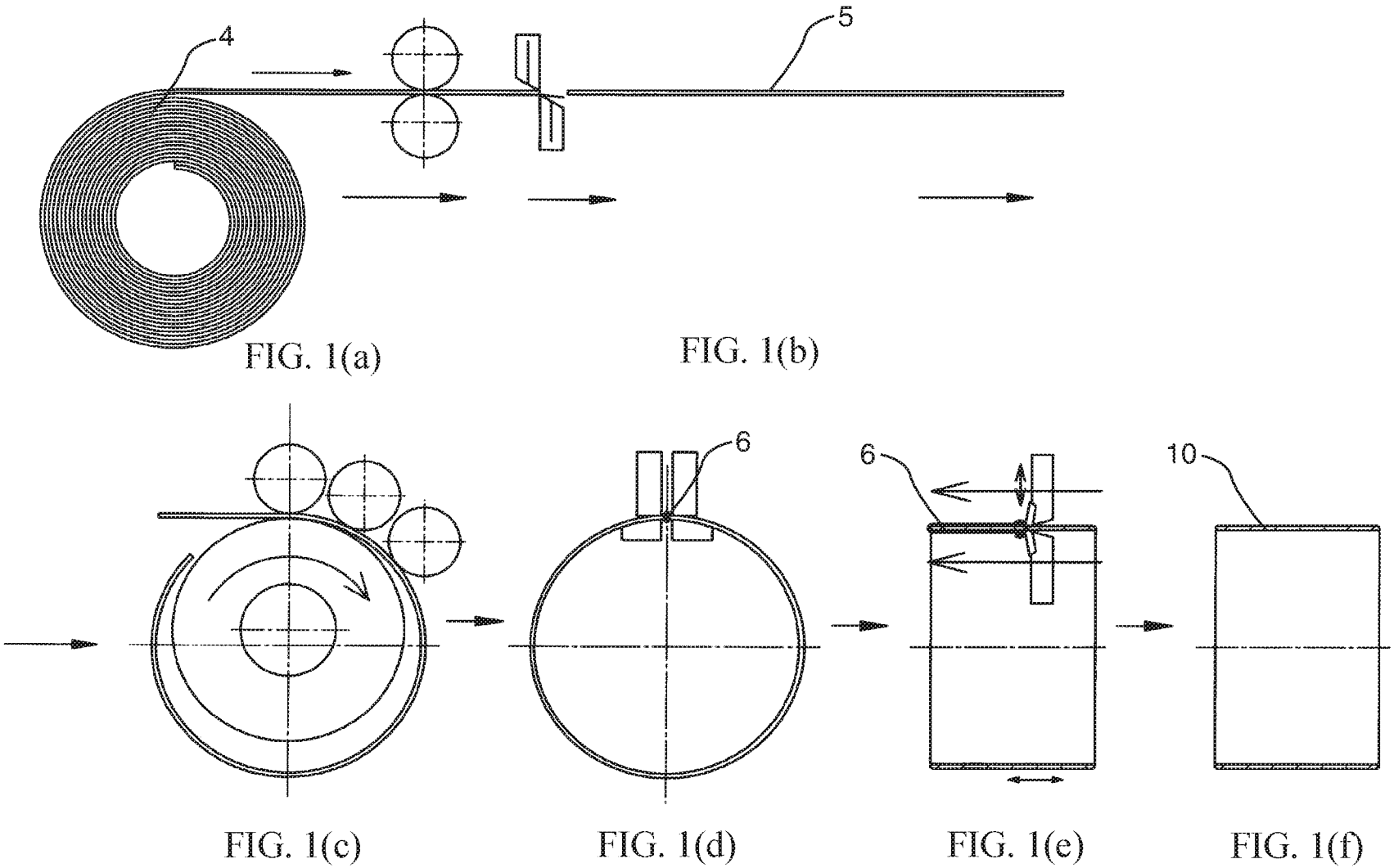
FIG. 1 is a process diagram illustrating a tube material manufacturing step, which is conducted before spinning, of a spinning method according to embodiments of the present invention, where (a) illustrates a coiled material wound in a state of a coil, (b) illustrates a rectangular flat steel plate, (c) illustrates a state where the steel plate is cylindrically wound, (d) illustrates a state where circumferentially opposite ends of the wound plate are welded to each other, (e) illustrates a state where a swell and/or a burr of a welded portion is trimmed, and (f) illustrates a tube material.

The spinning method may include a tube material manufacturing step for manufacturing the tube material 10 having a uniform thickness from a flat plate material 5 having a uniform thickness as illustrated in FIG. 1, before the clamping step of (A) above.

As illustrated in the tube material manufacturing steps (a) and (b) of FIG. 1, the flat plate material (rectangular material) 5 is manufactured by pulling out a plate having a uniform thickness in a straight manner from a coil of the plate and cutting the pulled-out straight plate at an interval of a predetermined length thereby successively manufacturing a plurality of flat plate materials. Then, as illustrated in steps (c)-(e) of FIG. 1, the flat plate material is rounded or coiled and opposite ends of the rounded material are welded to each other by flash butt-welding, butt-welding, or arc welding, etc., and then a burr of the welded portion 6 is trimmed so that a tube material 10 having a uniform thickness is manufactured.

In the tube material manufacturing step, the tube material 10 having a uniform thickness may be manufactured by cutting a pipe-like material (not shown) at an interval of a predetermined length.

As illustrated in FIGS. 2-4, at the clamping step of (A) above, the tube material 10 having a uniform thickness is inserted into the conical concavity 31 of the spindle-side chuck 30 and an axial position of the tube material relative to the spindle-side chuck is determined by contacting the axially outermost end 11*a* of the first axial end portion 11 of the tube material 10 to the bottom surface 31*a*, then the tube material 10 is enlarged in diameter by forcibly inserting the mandrel-side chuck 41 and the cylindrical portion 42 of the mandrel 40 into the tube material 10.

The first axial end portion 11 (i.e., the end portion of the tube material 10 on the side of the conical concavity 31) of the tube material 10 is deformed in the radial direction of the tube material by the inwardly facing side surface of the conical concavity 31 and the outwardly facing side surface of the mandrel-side chuck 41. The axially outermost end 11*a* of the first axial end portion 11 is deformed very little, if at all, in the radial direction of the tube material while the first axial end portion 11 as a whole is deformed to a conical configuration where the diameter is gradually enlarged in a direction away from the axially outermost end 11*a*.

The first axial end portion 11 is formed to a conical configuration corresponding in configuration to the shapes of the conical concavity 31 and the mandrel-side chuck 41.

The mandrel 40 having the cylindrical portion 42 and the mandrel-side chuck 41, which have diameters larger than the inner diameter of the tube material 10, is forcibly inserted into the tube material 10 so that the diameter of the tube material 10 is enlarged and the first axial end portion 11 of the tube material 10 is formed to a conical configuration.

The first axial end portion 11 of the tube material is squeezed between the inwardly facing side surface of the conical concavity 31 and the outwardly facing side surface of the mandrel-side chuck 41 so that the tube material 10 is clamped to the spinning apparatus 20. Therefore, by merely forcibly inserting the mandrel 40 into the tube material 10, the first axial end portion 11 of the tube material 10 is formed to a conical configuration and the tube material 10 is clamped to the spinning apparatus 20.

A portion 13 of the tube material 10 other than the first axial end portion 11 is supported by the cylindrical portion 42 of the mandrel 40 over the entire circumference of the portion 13 and the entire axial length of the portion 13, in a state where a diameter of the portion 13 is enlarged by the cylindrical portion 42 of the mandrel 40.

The first axial end portion 11 of the tube material 10 may be formed to a conical configuration by a method of reducing a diameter of the first axial end portion 11 or by a method having a step different from the clamping step (A) above. In the diameter reducing method, it is not necessary to enlarge the diameter of the tube material 10 when inserting the mandrel 40 into the tube material 10. FIG. 13 shows a case where the first axial end portion 11 of the tube material 10 has been formed to a conical configuration beforehand by another step different from the clamping step (A) above.

As illustrated in FIGS. 5 and 6, at the thickness-decreasing step (B) above, while the spindle-side chuck 30, the mandrel 40 and the tube material 10 are being rotated about the axis P, the thickness of the tube material 10 is decreased by pressing the spinning roll 50 against the portion 13 of the tube material 10 other than the first axially end portion 11 and moving the spinning roll 50 in the axial direction of the tube material 10. A thickness of the portion 13 of the tube material 10 other than the first axially end portion 11 is decreased by pressing the spinning roll 50 against the portion 13. At the thickness-decreasing step, a thickness of a portion required to be decreased in thickness of the tube material 10 is decreased in thickness.

The thickness decreasing of the tube material 10 is conducted by pressing radially the spinning roll 50 against a radially outer surface of the tube material 10 and moving axially the spinning roll 50 in a direction away from the first axially end portion 11 (to the second axial end portion 12) of the tube material 10. During the spinning, the tube material 10 is axially lengthened (extended) in a moving direction of the spinning roll 50. The thickness of the tube material 10 may be decreased by moving the spinning roll 50 in a direction approaching the first axial end portion 11 (i.e., in a direction away from the second axial end portion 12). In the case where the spinning roll 50 is moved in the direction approaching the first axial end portion 11, the tube material 10 is lengthened in a direction opposite to the moving direction of the spinning roll 50.

The tube material 10 having a uniform thickness is formed to the formed tube 15 the outer surface of which is the axially convex and concave surface by spinning at the thickness-decreasing step.

Figure 7:
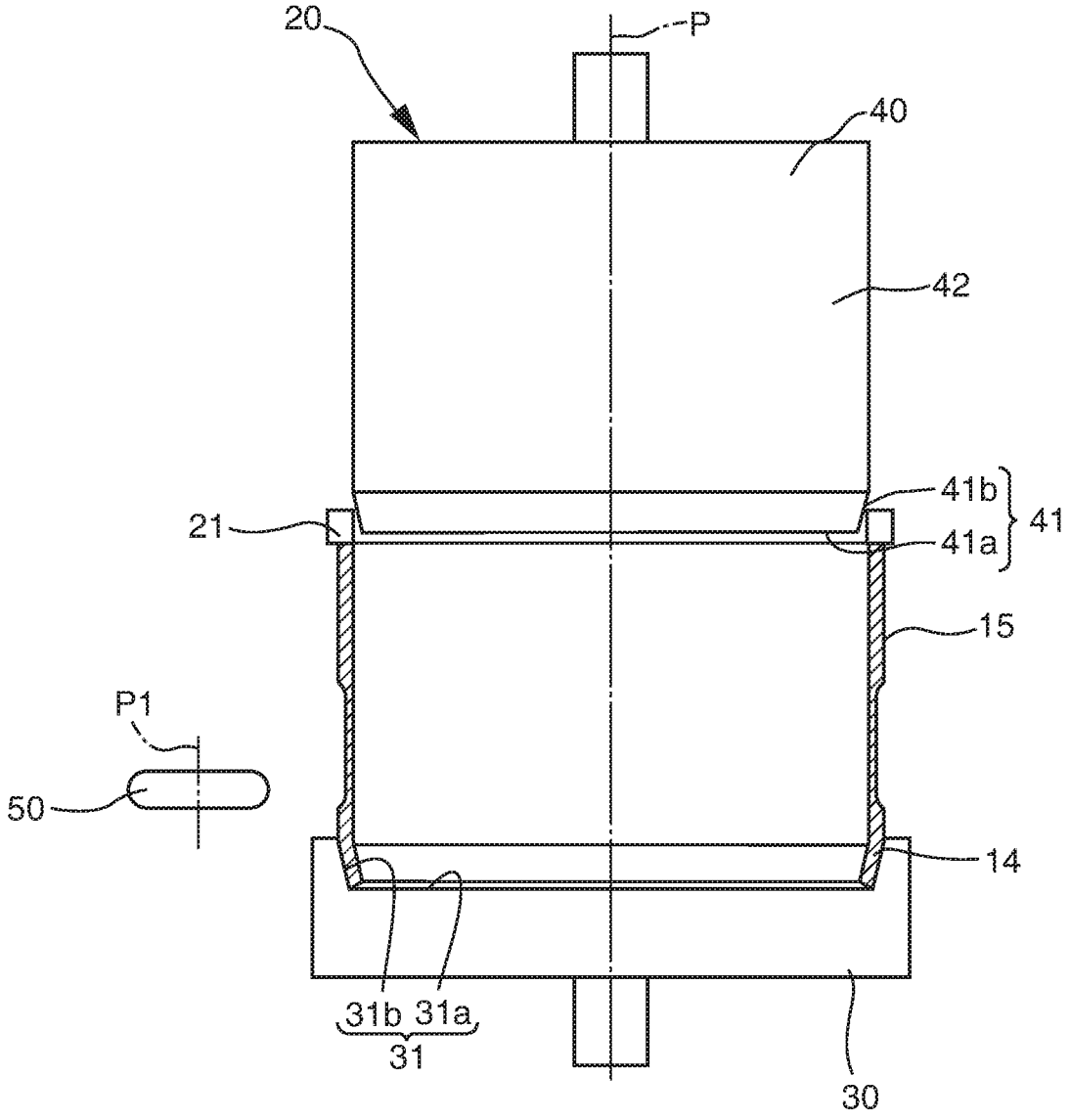
FIG. 7 is a cross-sectional view of the spinning apparatus according to a first embodiment of the present invention, in a state where a formed tube has been decreased in thickness and then the mandrel has been drawn out from the formed tube.
Figure 8:
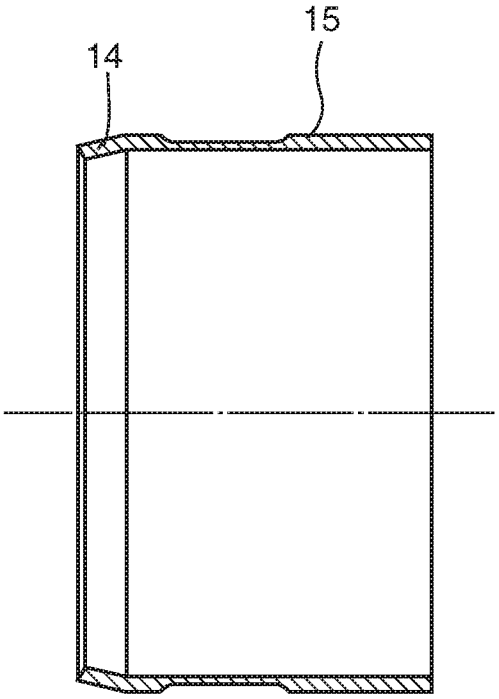
FIG. 8 is a cross-sectional view of the formed tube decreased in thickness by spinning method according to a first embodiment of the present invention.

As illustrated in FIG. 7, after the thickness-decreasing step of (B) above, the mandrel 40 is drawn out from the formed tube 15. At that time, the formed tube 15 is prevented from moving in an axial direction of the formed tube by a stopper 21 provided at the spinning apparatus 20.

As illustrated in FIG. 10, after the thickness-decreasing step, the formed tube 15 having a non-uniform thickness is roll-formed to a configuration of a vehicle wheel rim 100. As illustrated in FIG. 9, since the formed tube is roll-formed such that the flanges 101, 107 of the rim 100 are larger in diameter than the bead seats 102, 106 and the drop 104 of the rim 100 is smaller in diameter than the bead seats 102, 106, a roll-forming step is conducted after axially opposite ends of the formed tube 15 have been flared by using opposite flare dies 60, 61. As illustrated in (b) of FIG. 9, at a flaring step, the axially opposite ends of the formed tube 15 are enlarged (flared) to a conical configuration. A first axial end portion 14 of the formed tube 15 which has been radially inwardly formed to a conical configuration at the clamping step is reversely bent at the flaring step to a radially outwardly flared configuration.

As illustrated in FIG. 10, at the roll-forming, a wall of the formed tube 15 is squeezed between a lower roll 62 and an upper roll 63, and then the rolls are rotated, thereby forming the formed tube 15 to a configuration of the vehicle wheel rim 100.

Then, the wheel rim is sizing-formed to a final rim configuration (formed to a true circle and a cross section of a wheel rim for a vehicle) using an expander and/or a shrinker as illustrated in FIG. 11.

In conventional spinning, a cylindrical workpiece having a constant inner diameter was spinning-formed, maintaining a constant inner diameter, or was spinning-formed to a cylindrical workpiece having flared opposite ends thereof. This was because the cylindrical workpiece is roll-formed such that the flange portions 101, 107 of the rim 100 are larger in diameter than the bead seats 102, 106 and the drop 104 of the rim 100 is smaller in diameter than the bead seats 102, 104.

In the present invention, the first axial end portion 11 of the tube material 10 is deformed in diameter so as to be enlarged in diameter in a direction approaching the portion 13 other than the first axial end portion 11 of the tube material 10 from the axially outermost end 11*a* of the first axial end portion 11, so that the first axial end portion 11 is deformed to the conical configuration as distinct from the flaring configuration. Therefore, the tube material 10 can be clamped by the spinning apparatus 20 at the first axial end portion of the tube material.

The enlarged amount in diameter of the tube material is selected such that the tube material can be clamped between the spindle-side chuck 30 and the mandrel 40 and such that the formed tube 15 can be easily removed from the conical concavity 31 of the spindle-side chuck 30. The enlarged amount is selected to be, for example, about a thickness of the flat plate material 5 in a radial direction of the tube material. Therefore, the spinning can be conducted by a simple mechanism and the flaring and the roll-forming can be conducted without causing any problem.

Next, technical advantages according to the embodiment of the present invention will be explained.

By clamping the tube material 10 at the first axial end portion 11 of the tube material between the conical concavity 31 of the spindle-side chuck 30 and the mandrel-side chuck 41 of the mandrel 40 and then pressing the spinning roll 50 against the tube material 10 when the tube material is supported by the cylindrical portion 42 of the mandrel 40, the thickness of the tube material 10 can be decreased. Therefore, the clamping structure is simpler and fewer forming processes are required as compared to conventional spinning, so that a forming time can be shortened.

Since the thickness of the tube material 10 is decreased by pressing the spinning roll 50 against the tube material 10 when the tube material is supported by the cylindrical portion 42 of the mandrel 40, the tube material decreased in thickness has a substantially constant inner diameter and has a simpler configuration than that of a conventional tube material. Therefore, it is relatively easy to use the mandrel die as a common die for forming wheel rims of various types.

Since the first axial end portion 11 of the tube material 10 is squeezed between the conical concavity 31 of the spindle-side chuck 30 and the mandrel-side chuck 41 of the mandrel 40 so that the tube material 10 is clamped, the tube material 10 can be securely clamped at the first axial end portion 11 of the tube material.

Since the diameter of the axially outermost end of the mandrel-side chuck 41 of the mandrel 40 is smaller than the inner diameter of the axially outermost end 12*a* of at least the second axial end portion 12 of the tube material 10, the mandrel 40 can be surely inserted into the tube material 10.

Further, since the diameter of the cylindrical portion 42 of the mandrel 40 is larger than the inner diameter of the axially outermost end 11*a* of at least the first axial end portion 11 of the tube material 10, the tube material 10 can be stably and securely supported by the cylindrical portion 42 of the mandrel 40.

Since the first axial end portion 11 of the tube material 10 is formed (bent) to a conical configuration by being squeezed between the conical concavity 31 of the spindle-side chuck 30 and the mandrel-side chuck 41 of the mandrel 40 so that the tube material 10 is clamped to the spinning apparatus at the first axial end portion 11 of the tube material 10, the tube material 11 can be securely clamped by fewer processes.

Since the cylindrical portion 42 of the mandrel 40 having a diameter equal to or larger than the inner diameter of the tube material 10 is forcibly inserted into the tube material 10 so that the diameter of the tube material 10 is enlarged and the first axial end portion 11 of the tube material 10 is formed to a conical configuration, a true roundness of the tube material 10 and a dimensional accuracy of the inner diameter of the tube material 10 are improved, whereby the thickness reduction can be stably performed.

Since the thickness of the tube material 10 can be decreased by pressing the spinning roll 50 against the radially outer surface of the tube material 10 and moving the spinning roll 50 in the direction away from the first axial end portion 11 (to the second axial end portion 12) of the tube material 10, it is possible to decrease the thicknesses of necessary portions of the tube material.

Further, since the tube material 10 can be lengthened in the moving direction of the spinning roll 50 (lengthening in a forward type), it is easy to form the tube material to the formed tube compared with a case where the tube material 10 is lengthened in the direction opposite to the moving direction of the spinning roll 50 (lengthening in a backward type).

The method of manufacturing a vehicle wheel rim is conducted by using the spinning apparatus 20 which includes (a) the spindle-side chuck 30 having the conical concavity 31, (b) the mandrel 40 including (i) the mandrel-side chuck 41 formed in a form of a conical convexity corresponding in configuration to the conical concavity 31 of the spindle-side chuck 30 and (ii) the cylindrical portion 42 for supporting the tube material 10 and (c) the spinning roll 50 for decreasing the thickness of the tube material 10 by pressing the spinning roll 50 against the tube material 10 when the tube material 10 is supported by the cylindrical portion 42 of the mandrel 40.

The method comprises:

clamping the tube material 10 at the first axial end portion 11 of the tube material between the conical concavity 31 of the spindle-side chuck 30 and the mandrel-side chuck 41 of the mandrel 40, where the mandrel-side chuck 41 is formed in a form of a conical convexity;

decreasing by spining a thickness of the tube material 10 by pressing the spinning roll 50 against the tube material 10 supported by the cylindrical portion 42 of the mandrel 40 to form the formed tube 15 having a non-uniform thickness; and flaring axially opposite ends of the formed tube 15 to conical configurations.

Therefore, the vehicle wheel rim 100 can be efficiently manufactured by simple processes.

EXPLANATION OF REFERENCE NUMERALS

4 coiled material
5 flat plate material
6 weld portion
10 tube material having a uniform thickness
11 first axial end portion of the tube material
11*a* axially outermost end of the first axial end portion of the tube material
12 second axial end portion of the tube material
12*a* axially outermost end of the second axial end portion of the tube material
14 first axial end portion of a formed tube
15 formed tube having a non-uniform thickness
20 spinning apparatus
21 stopper
30 spindle-side chuck
31 conical concavity
31*a* bottom surface of the conical concavity
31*b* inwardly facing side surface of the conical concavity
40 mandrel
41 mandrel-side chuck formed in a form of conical convexity
41*a* end surface of the mandrel-side chuck
41*b* outwardly facing side surface of the mandrel-side chuck
42 cylindrical portion
50 spinning roll
60, 61 opposite flare dies
62 lower roll
63 upper roll
100 vehicle wheel rim

The invention claimed is:

1. A spinning apparatus for decreasing by spinning a thickness of at least a portion of a tube material of a vehicle wheel rim having a uniform thickness comprising:

a spindle-side chuck having a conical concavity;

a mandrel including (i) a mandrel-side chuck formed in a form of a conical convexity corresponding in configuration to the conical concavity of the spindle-side chuck and (ii) a cylindrical portion for supporting the tube material, the mandrel-side chuck including a cylindrical portion-side end of the mandrel-side chuck encompassed within the conical convexity configuration, a diameter at the cylindrical portion-side end of the mandrel-side chuck configured to be larger than an inner diameter of the tube material; and a spinning roll for decreasing the thickness of the tube material except at a first axial end portion thereof by pressing the spinning roll against the tube material when the tube material is supported by the cylindrical portion of the mandrel.

2. The spinning apparatus according to claim 1, wherein the mandrel causes the first axial end portion of the tube material to enlarge to a conical configuration by inserting the mandrel-side chuck of the mandrel into the tube material, and the mandrel and the spindle-side chuck are caused to squeeze the first axial end portion of the tube material which has been enlarged to the conical configuration between the conical concavity of the spindle-side chuck and the mandrel-side chuck of the mandrel.

3. The spinning apparatus according to claim 1, wherein a diameter of an axially outermost end of the mandrel-side chuck of the mandrel is smaller than an inner diameter of an axially outermost end of at least a second axial end portion of the tube material, and a diameter of the cylindrical portion of the mandrel is larger than an inner diameter of at least an axially outermost end of the first axial end portion of the tube material.

4. A spinning method of decreasing by spinning a thickness of at least a portion of a tube material of a vehicle wheel rim having a uniform thickness comprising:

clamping the tube material at a first axial end portion of the tube material between a conical concavity of a spindle-side chuck and a mandrel-side chuck of a mandrel, the mandrel-side chuck formed in a form of a conical convexity, the mandrel-side chuck including a cylindrical portion-side end of the mandrel-side chuck encompassed within the conical convexity configuration, a diameter at the cylindrical portion-side end of the mandrel-side chuck configured to be larger than an inner diameter of the tube material, then decreasing by spinning the thickness of the tube material except at the first axial end portion thereof, by pressing a spinning roll against the tube material supported by a cylindrical portion of the mandrel.

5. The spinning method according to claim 4, wherein at the clamping step; the first axial end portion of the tube material is enlarged in diameter and formed to a conical configuration by inserting the mandrel-side chuck of the mandrel into the tube material and is squeezed between the conical concavity of the spindle-side chuck and the mandrel-side chuck of the mandrel so that the tube material is clamped to a spinning apparatus at the first axial end portion of the tube material.

6. The spinning method according to claim 5, wherein at the clamping step, a portion of the tube material other than the first axial end portion of the tube material is enlarged in diameter and supported by the cylindrical portion of the mandrel by inserting the cylindrical portion of the mandrel into the tube material.

7. A method of manufacturing a vehicle wheel rim from a tube material having a uniform thickness conducted by using a spinning apparatus which includes (a) a spindle-side chuck having a conical concavity, (b) a mandrel including (i) a mandrel-side chuck formed in a form of a conical convexity corresponding in configuration to the conical concavity of the spindle-side chuck and (ii) a cylindrical portion for supporting the tube material, the mandrel-side chuck including a cylindrical portion-side end of the mandrel-side chuck encompassed within the conical convexity configuration, a diameter at the cylindrical portion-side end of the mandrel-side chuck configured to be larger than an inner diameter of the tube material and (c) a spinning roll for decreasing the thickness of the tube material by pressing the spinning roll against the tube material when the tube material is supported by the cylindrical portion of the mandrel, the method comprising:

clamping the tube material at a first axial end portion of the tube material between the conical concavity of the spindle-side chuck and the conical convexity of the mandrel-side chuck;

decreasing by spinning the thickness of the tube material by pressing the spinning roll against the tube material supported by the cylindrical portion of the mandrel to form a formed tube having a non-uniform thickness;

flaring axially opposite ends of the formed tube to conical configurations; and roll-forming the formed tube to a configuration of the vehicle wheel rim, wherein at the clamping step, the first axial end portion of the tube material is enlarged in diameter and radially inwardly formed to a conical configuration and a portion of the tube material other than the first axial end portion of the tube material is enlarged in diameter and supported by the cylindrical portion of the mandrel, by inserting the mandrel-side chuck and the cylindrical portion of the mandrel into the tube material, and at the flaring step, the first axial end portion which has been radially inwardly formed to a conical configuration at the clamping step is reversely bent to a radially outwardly flared configuration.

* * * * *